US008695192B2

(12) United States Patent
Mann

(10) Patent No.: US 8,695,192 B2
(45) Date of Patent: Apr. 15, 2014

(54) APPARATUS AND METHOD FOR CONTINUOUSLY CLEANING AND PAINTING OF LARGE SURFACES AND HIGH WALLS

(75) Inventor: Aviram Mann, Modiín (IL)

(73) Assignee: Aviram Mann, Modiin (IL)

( * ) Notice: Subject to any disclaimer, the term of this patent is extended or adjusted under 35 U.S.C. 154(b) by 429 days.

(21) Appl. No.: 12/998,631

(22) PCT Filed: Nov. 12, 2009

(86) PCT No.: PCT/IL2009/001062

§ 371 (c)(1),
(2), (4) Date: May 9, 2011

(87) PCT Pub. No.: WO2010/055506

PCT Pub. Date: May 20, 2010

(65) Prior Publication Data

US 2011/0209326 A1 Sep. 1, 2011

(30) Foreign Application Priority Data

Nov. 16, 2008 (IL) ..... 195299

(51) Int. Cl.
*B25B 27/14* (2006.01)

(52) U.S. Cl.
USPC ..... 29/281.6

(58) Field of Classification Search
USPC ..... 29/428, 281.6, 402.01, 458, 527.2; 15/49.1; 451/92, 354; 239/264
See application file for complete search history.

(56) References Cited

U.S. PATENT DOCUMENTS 3,344,454 A * 10/1967 Mikalson ..... 15/50.3
3,637,047 A * 1/1972 Cox ..... 182/222
5,240,503 A * 8/1993 Levy et al. ..... 118/323
5,730,646 A * 3/1998 Watkin ..... 451/92

* cited by examiner

*Primary Examiner* — John C Hong

(57) ABSTRACT

A system for applying working equipment onto an external wall of a structure. One system comprises a suspended platform anchored to the structure, operably vertically moveable at a constant speed along the external wall; and a positioning system arranged to determine and control a predefined motion pattern of the working equipment relative to the suspended platform, the positioning system mounted on the suspended platform. The predefined motion pattern is selected such as to allow continuous and uniform application of the working equipment horizontally and vertically onto the external wall during the vertical movement of the suspended platform along the external wall. The predefined motion pattern comprises a diagonal movement comprising a vertical component and a horizontal component, wherein the vertical component is equal and opposed to the vertical movement of the suspended platform.

15 Claims, 6 Drawing Sheets

APPARATUS AND METHOD FOR CONTINUOUSLY CLEANING AND PAINTING OF LARGE SURFACES AND HIGH WALLS

BACKGROUND

1. Technical Field

The present invention relates to the field of maintaining structures, and more particularly, to uniformly processing external walls.

2. Discussion of Related Art

Processing external walls of structures (e.g. painting, cleaning, polishing) are complicated tasks characterized by strenuous work in risky conditions, and an ever growing extent and need.

BRIEF SUMMARY

Embodiments of the present invention provide a system for applying working equipment onto an external wall of a structure. One system comprises a suspended platform anchored to the structure, operably vertically moveable at a constant speed along the external wall; and a positioning system arranged to determine and control a predefined motion pattern of the working equipment relative to the suspended platform, the positioning system mounted on the suspended platform. The predefined motion pattern is selected such as to allow continuous and uniform application of the working equipment horizontally and vertically onto the external wall during the vertical movement of the suspended platform along the external wall.

Accordingly, according to an aspect of the present invention, there is provided a system, wherein the predefined motion pattern comprises a diagonal movement comprising a vertical component and a horizontal component, wherein the vertical component is equal and opposed to the vertical movement of the suspended platform.

Accordingly, according to another aspect of the present invention, there is provided a system, wherein the predefined motion pattern comprises a plurality of cycles. Each cycle comprises: vertical movements in which the working equipment is applied to vertical segments of the external wall; and diagonal movements comprising a vertical component and a horizontal component, wherein the vertical component is equal and opposed to the vertical movement of the suspended platform, and in which the working equipment is applied to horizontal segments of the external wall.

Accordingly, according to yet another aspect of the present invention, there is provided a system, wherein the working equipment comprises at least one of: a painting instrument, a wall cleaning instrument, a wall processing instrument.

Embodiments of the present invention provide a method of applying a working equipment onto an external wall of a structure. One method comprises: movably connecting the working equipment to a suspended platform anchored to the structure and arranged to move vertically up and down along the external wall; and moving the working equipment according to a predefined motion pattern relative to the suspended platform and applying the working equipment onto the external wall. The predefined motion pattern is selected such as to allow continuous and uniform application of the working equipment horizontally and vertically onto the external wall during the vertical movement of the suspended platform along the external wall.

Embodiments of the present invention provide a system for applying working equipment onto an external wall of a structure. One system comprises a suspended platform; a positioning system; a plurality of supporting wheels; and a plurality of ventilators. The suspended platform is anchored to the structure, operably vertically moveable at a constant speed along the external wall, and arranged to cover a plurality of vertical bands on the external wall by moving up and down the vertical bands. The positioning system is arranged to determine and control a predefined motion pattern of the working equipment relative to the suspended platform. The positioning system is mounted on the suspended platform and comprises: a support connected to the suspended platform; a conveyor pivotly mounted on the support, the conveyor arranged to be controllably swung on a pivot; and a transporter connected to the conveyor and arranged to be controllably moved along the conveyor according to the predefined motion pattern. The working equipment is connected to the transporter such as to be applicable to the external wall. The supporting wheels are connected to the suspended platform and arranged to stabilize and direct movements of the suspended platform. The ventilators are connected to the suspended platform and are arranged to secure a constant contact to the external wall and to stabilize suspended platform. The predefined motion pattern is selected such as to allow continuous and uniform application of the working equipment horizontally and vertically onto the external wall during the vertical movement of the suspended platform along the external wall. The predefined motion pattern comprises a plurality of cycles, each cycle comprising: vertical movements of the transporter generated by swings of the conveyor, in which the working equipment is applied to vertical segments of the external wall; and diagonal movements of the transporter along the conveyor, each diagonal movement comprising a vertical component and a horizontal component, wherein the vertical component is equal and opposed to the vertical movement of the suspended platform, and in which the working equipment is applied to horizontal segments of the external wall.

These, additional, and/or other aspects and/or advantages of the present invention are: set forth in the detailed description which follows; possibly inferable from the detailed description; and/or learnable by practice of the present invention.

BRIEF DESCRIPTION OF THE DRAWINGS

The present invention will be more readily understood from the detailed description of embodiments thereof made in conjunction with the accompanying drawings of which.

DETAILED DESCRIPTION

Figure 1:
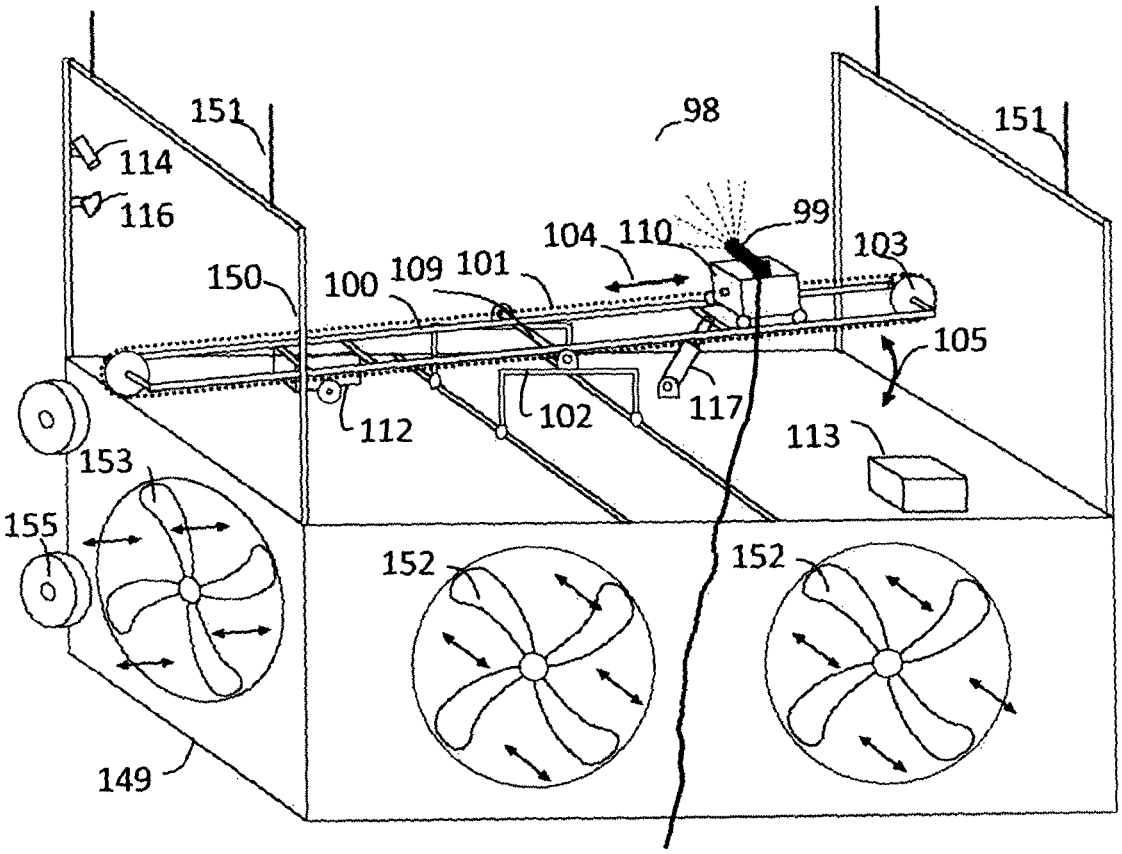
FIG. 1 is a schematic illustration of a system for applying working equipment onto an external wall of a structure, according to some embodiments of the invention.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 is a schematic illustration of a system for applying working equipment 99 onto an external wall 98 of a structure, according to some embodiments of the invention. The system comprises a suspended platform 150 anchored to the structure e.g., by cables 151 connected to a crane (188 in FIG. 3D) on the rooftop (189 in FIG. 3D). Structure may include buildings, ships, chimneys, shafts, granaries, etc. In operation, suspended platform 150 is arranged to move vertically at a constant speed up and down along external wall 98. Suspended platform 150 is arranged to allow applying working equipment 99 onto extended parts of external wall 98 by sequentially applying working equipment 99 to vertical bands (see FIG. 3D) of external wall 98. The system further comprises a positioning system 100 mounted on suspended platform 150 and arranged to determine and control a predefined motion pattern of working equipment 99. The predefined motion pattern is selected such as to allow continuous and uniform application of working equipment 99 horizontally and vertically onto external wall 98 during the vertical movement of suspended platform 150 along external wall 98.

According to some embodiments of the invention, working equipment 99 may comprise various instruments for painting, cleaning or processing external wall 98, such as: a painting instrument, a wall cleaning instrument, a wall processing instrument.

According to some embodiments of the invention, predefined motion pattern may be selected as to generate horizontal and vertical movements of working equipment 99, and in particular avoid diagonal movement of working equipment 99. Predefined motion pattern is selected such that its superposition upon the vertical movement of suspended platform 150 generates horizontal and vertical predefined motion patterns. For example, the predefined motion pattern may be diagonal with a vertical component that is equal and opposed to the vertical movement of suspended platform 150.

According to some embodiments of the invention, the predefined motion pattern may be implemented using positioning system 100 mounted upon suspended platform 150. Positioning system 100 may comprise a transporter 110 connected to a conveyor 101, e.g. comprising pulleys 103. Working equipment 99 is connected to transporter 110 such as to operate on external wall 98. Transporter 110 and conveyor 101 are arranged to allow moving working equipment 99 according to the predefined motion pattern. For example, conveyor 101 may be mounted on a pivot 109 of a support 102 (pivot 109 may be connected to support 102 e.g. via a bearing) connected to suspended platform 150. Conveyor 101 may be allowed to swing (105) on pivot 109 in a controlled manner (see FIGS. 3A, 3B, 3C below).

According to some embodiments of the invention, a control unit 113 may control swinging of conveyor 101, e.g. by means of a piston 117 arranged to heave and lower conveyor 101. A motor 112 may be connected to conveyor 101 and arranged to move (104) transporter 110 along conveyor 101. Motor 112 may be either connected to transporter 110 or not, and motion control of transporter 110 may be a combination of direct influence of either motor 112, conveyor 101 or both. Control unit 113 is connected to motor 112 and arranged to control motor 112. Altogether, control unit 113, motor 112, conveyor 101, pulleys 103, pivot 109 and transporter 110 are arranged and configured to move working equipment 99 according to the predefined motion pattern.

According to some embodiments of the invention, accessories such as lighting means 116 or a camera 114 may be attached to suspended platform 150 to improve working quality and allow external control on working equipment 99 via control unit 113. For example a control center (not shown) may be connected to camera 114, receive images of external wall 98 and working equipment 99, and control the predefined motion pattern via control unit 113.

According to some embodiments of the invention, suspended platform 150 may further comprise a stabilization unit 149 connected to suspended platform 150 and arranged to secure a constant contact to external wall 98, to stabilize suspended platform 150 and to direct movements of suspended platform 150. Stabilization unit 149 may comprise, for example supporting wheels 155 or ventilators 152, 153.

According to some embodiments of the invention, suspended platform 150 may be stabilized and in constant contact with external wall 98 by means of supporting wheels 155, as well as by air pressure generated by ventilators 152, 153 at the sides of suspended platform 150 that are remote from external wall 98. Supporting wheels 155 and ventilators 152, 153 may be controllable and used to enhance the efficiency and uniformity of applying working equipment 99.

Figure 2A:
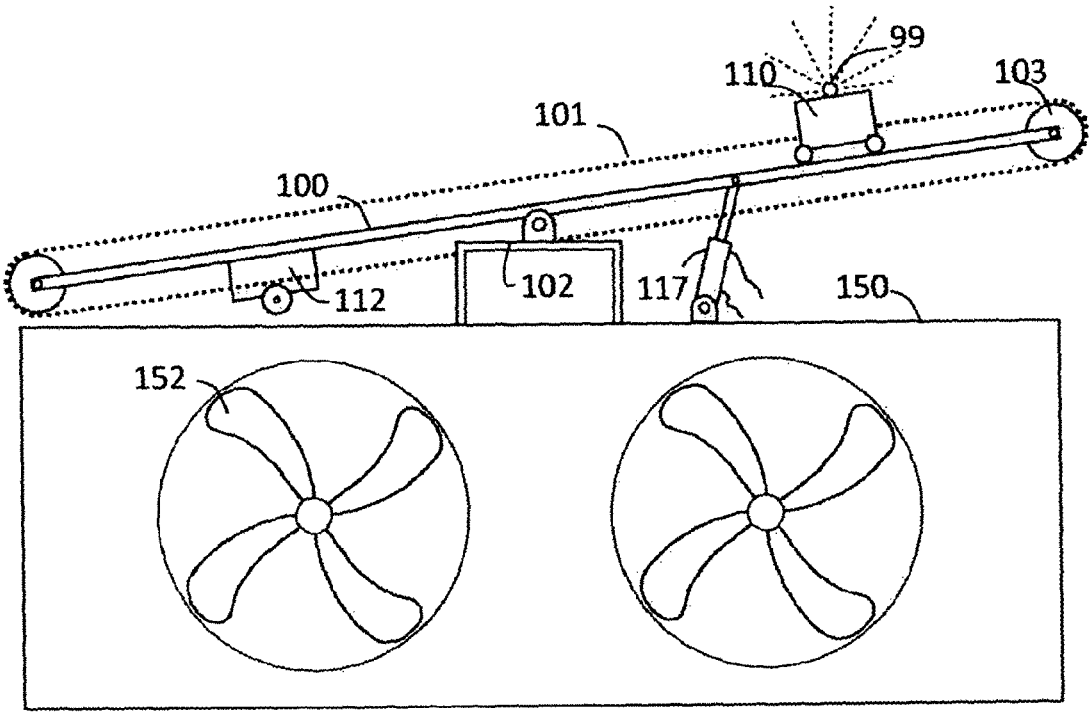
FIGS. 2A and 2B are schematic illustrations of positioning systems, according to some embodiments of the invention.
Figure 2B:
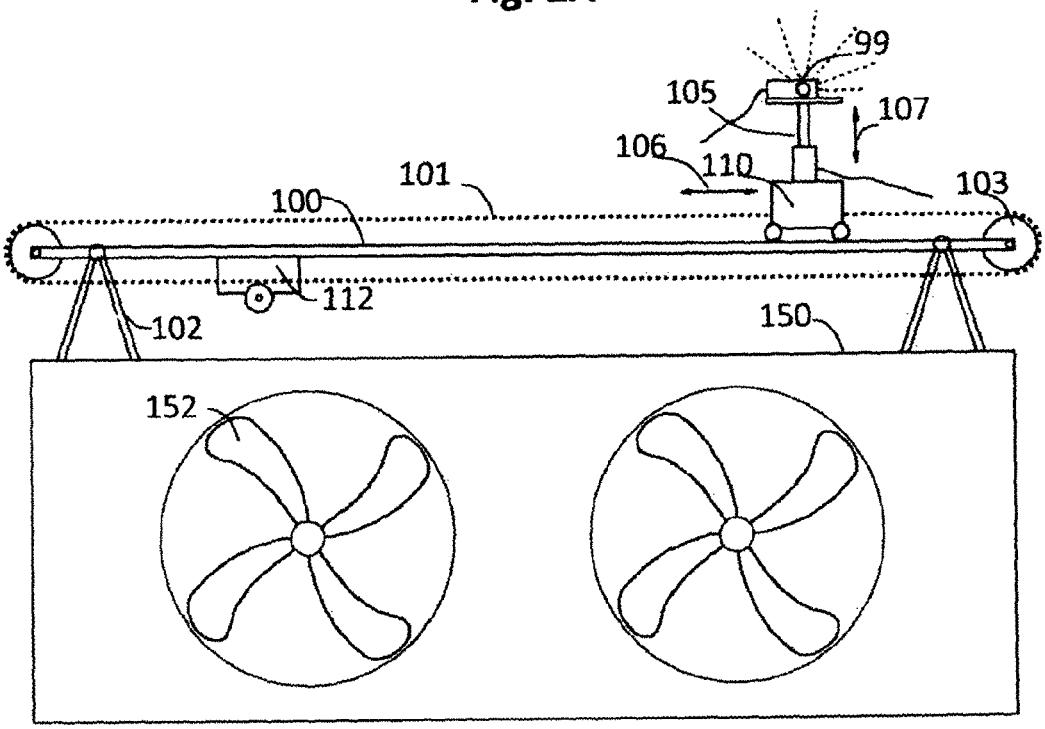

FIGS. 2A and 2B are schematic illustrations of positioning systems 100, according to some embodiments of the invention. FIG. 2A is a non-perspective view of an embodiment similar to the one described in FIG. 1. Positioning system 100 comprises transporter 110 movably connected to conveyor 101, that is pivotly mounted on support 102 and arranged to be swung by piston 117. Support 102 is connected to suspended platform 150. Conveyor 101 is pivotly mounted on support 102, and is arranged to be controllably swung on pivot 109. Transporter 110 is connected to conveyor 101 and is arranged to be controllably moved along conveyor 101 according to the predefined motion pattern. Working equipment 99 is connected to transporter 110 such as to be applicable to external wall 98. The system may further comprise piston 117 connected to a motor (not shown) and to control unit 113. Piston 117 is arranged to heave and lower conveyor 101 according to control commands from control unit 113. The system may further comprise motor 112 connected to transporter 110 and to control unit 113. Control unit 113 is arranged to move transporter 110 according the predefined motion pattern in relation to movements of conveyor 101.

FIG. 2B illustrates a different embodiment of positioning system 100 comprising a fixed horizontal conveyor 101 with a movably attached transporter 110, and a vertical piston 105 supporting working equipment 99 that is mounted upon transporter 110. Conveyor 101 is arranged to move (106) working equipment 99 horizontally, while vertical piston 105 is arranged to move (107) working equipment 99 vertically. Vertical motion 107 may be arrange to counteract the vertical motion of suspended platform 150. Positioning system 100 may comprise support 102, fixed horizontal conveyor 101 and transporter 110. Support 102 is connected to suspended platform 150, and conveyor 101 is mounted on support 102. Transporter 110 is connected to fixed horizontal conveyor 101 and arranged to be controllably moved along conveyor 101 according to the predefined motion pattern. Transporter 110 may comprise vertical piston 105 and working equipment 99 may be connected to vertical piston 105 such as to be applicable onto external wall 98. Vertical piston 105 may be arranged to controllably move working equipment 99 according to the predefined motion pattern in relation to the controlled movements of transporter 110 on fixed horizontal conveyor 101.

According to some embodiments of the invention, the predefined motion pattern comprises a plurality of cycles, each cycle comprising vertical movements and diagonal movements of working equipment 99. The vertical movements are generated by movements of vertical piston 105, in which working equipment 99 is applied to vertical segments of external wall 98. The diagonal movements comprise vertical movements generated by movements of vertical piston 105 and horizontal movements generated by fixed horizontal conveyor 101. The vertical movements are equal and opposed to the vertical movement of suspended platform 150, and the horizontal movements are configured to enable applying working equipment 99 to horizontal segments of external wall 98.

Figures 3A, 3B, 3C:
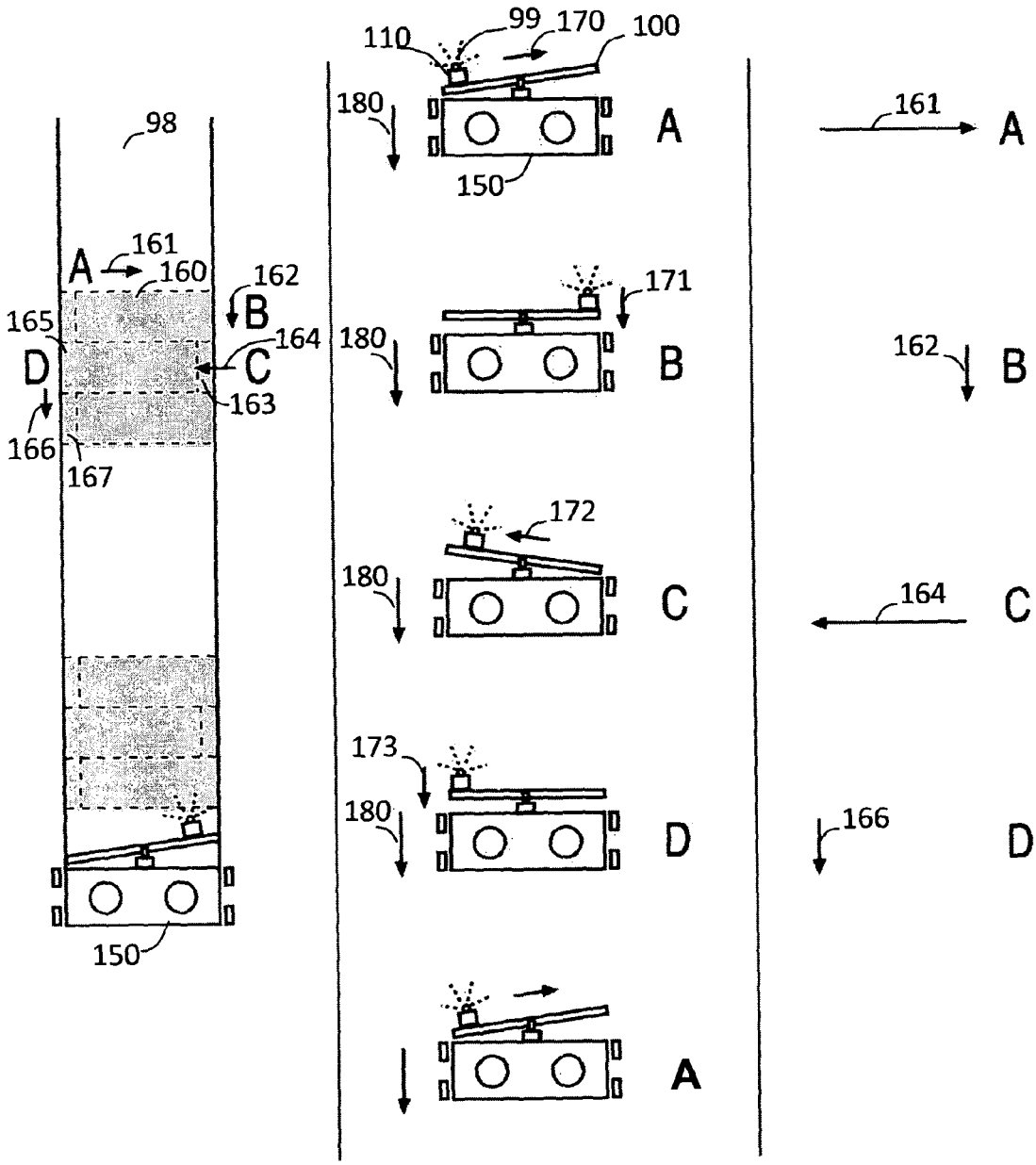
FIGS. 3A, 3B, 3C and 3D are high level schematic diagrams illustrating application of the working equipment during a vertical movement of the suspended platform, according to some embodiments of the invention.

FIGS. 3A, 3B, 3C and 3D are high level schematic diagrams illustrating application of working equipment 99 during a vertical movement 180 of suspended platform 150, according to some embodiments of the invention. FIG. 3A is an illustration of processed segments 160, 163, 165, 167 (in grey) of external wall 98, within a vertical band (see FIG. 3D) processed by working equipment 99 on suspended platform 150 during a single downwards vertical movement 180. One cycle of positioning system 100 applying working equipment 99 is shown in detail in FIG. 3B and FIG. 3C. The cycle comprises four phases—marked by the letters A, B, C, D. At phase A, transporter 110 moves (170) along conveyor 101 at an inclined position, such that the vertical component of movement 107 equals and is opposite to vertical movement 180 of suspended platform 150. Thus, the movement of transporter 110 and working equipment 99 in respect to external wall 98 equals the horizontal component (161) of movement 170. During phase A, working equipment 99 is applied onto horizontal segment 160 of external wall 98. At phase B, conveyor 101 swings and transporter 110 moves vertically downwards (171), applying working equipment 99 on vertical segment 163 of external wall 98 by a vertical movement 162 that combines vertical movements of transporter 110 (171) and suspended platform 150 (180). At phase C, after swing 171 is completed, transporter 110 moves diagonally 172, with a vertical component that is equal and opposite to vertical movement 180 of suspended platform 150. In this manner, the movement of transporter 110 and working equipment 99 relative to external wall 98 equals the horizontal component of movement 172, which is marked by 164. During phase C, working equipment 99 is applied to horizontal segment 165 of external wall 98. Finally, phase D is similar to phase B, and comprises a downwards swing 173 of transporter 110, resulting in a vertical movement 166 of working equipment 99 and its application to vertical segment 167 of external wall 98. The cycle is repeated until a vertical band 185 (FIG. 3D) of external wall 98 is processed by working equipment 99.

Figure 3D:
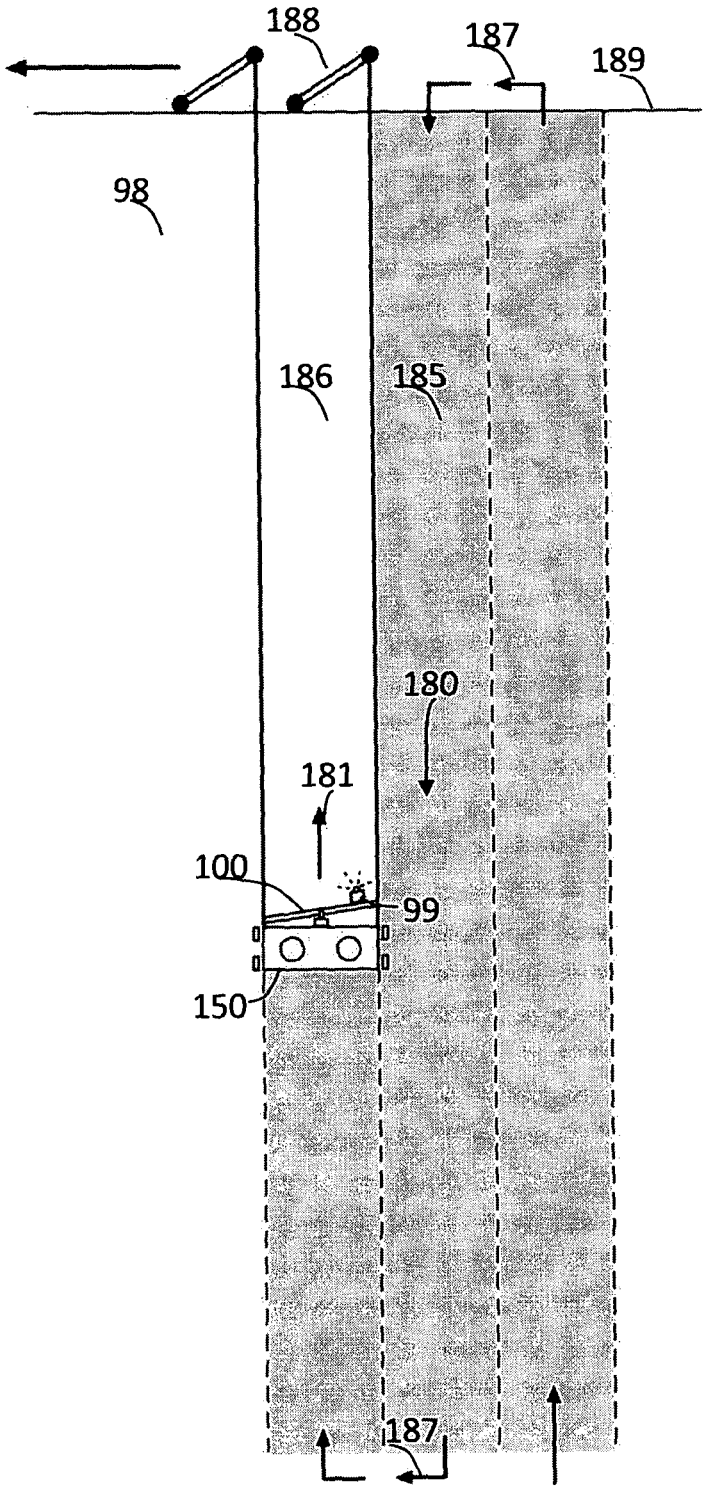

FIG. 3D illustrates the system comprises a suspended platform 150 anchored to the structure e.g., by cables 151 connected to crane 188 on the rooftop 189. In operation, suspended platform 150 is arranged to move vertically at a constant speed up 181 and down 180 along external wall 98. Suspended platform 150 is arranged to allow applying working equipment 99 onto extended parts of external wall 98 by sequentially applying working equipment 99 to vertical bands 185, 186 of external wall 98. The system further comprises positioning system 100 mounted on suspended platform 150 and arranged to determine and control a predefined motion pattern of working equipment 99. The predefined motion pattern is selected such as to allow continuous and uniform application of working equipment 99 horizontally and vertically onto external wall 98 during vertical movement 180, 181 of suspended platform 150 along external wall 98.

According to some embodiments of the invention, consequent vertical bands 185, 186 of external wall 98 may be processed by moving suspended platform 150 vertically up (181) and down (180) at consequent vertical bands 185, 186. The motion pattern of transporter 110 may be adjusted to upwards vertical movement 181 of suspended platform 150 by replacing the downwards movement 180 with the upwards movement 181 in calculating the predefined motion pattern. In particular, movements 170, 171, 172 and 173 may be adapted such that combining their vertical components with upwards movement 181 still allow continuous and uniform processing of the horizontal and vertical segments of external wall 98. Suspended platform 150 may switch between vertical bands 185, 186 by horizontal movements 187 at the ends of vertical bands 185, 186.

According to some embodiments of the invention, the predefined motion pattern comprises multiple cycles. Each cycle may comprise vertical movements 171, 173 and diagonal movements 170, 172. Vertical movements 171, 173 allow applying working equipment 99 to vertical segments 163, 167 of external wall 98. Diagonal movements 170, 172 comprise a vertical component and a horizontal component. The vertical component is equal and opposed to vertical movement 180, 181 of suspended platform 150. Thus, the movement of working equipment 99 relative to external wall 98 is horizontal 161, 164 and allows applying working equipment 99 onto external wall 98 to process horizontal segments 160, 165 of external wall 98.

Figure 4A:
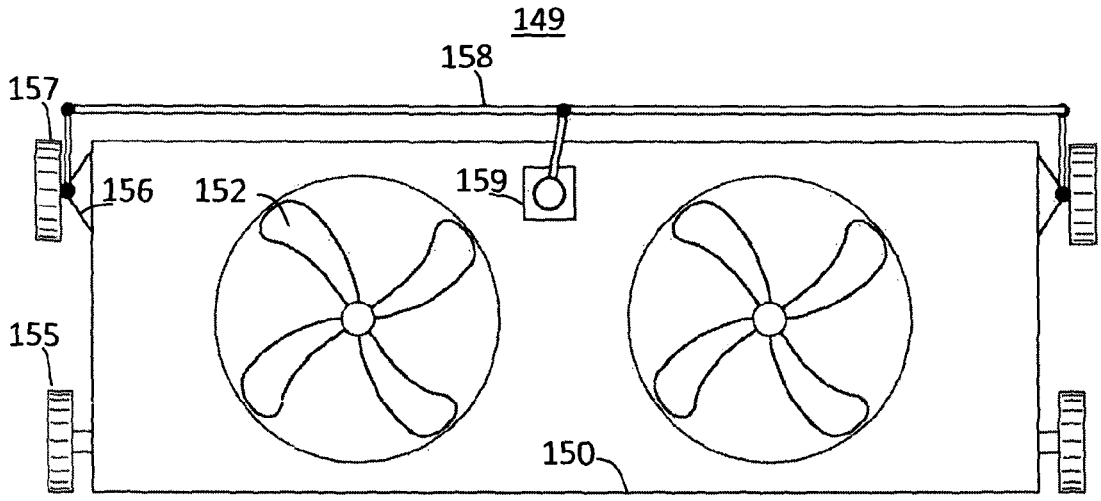
FIGS. 4A and 4B are schematic illustrations of the stabilization unit, according to some embodiments of the invention.
Figure 4B:
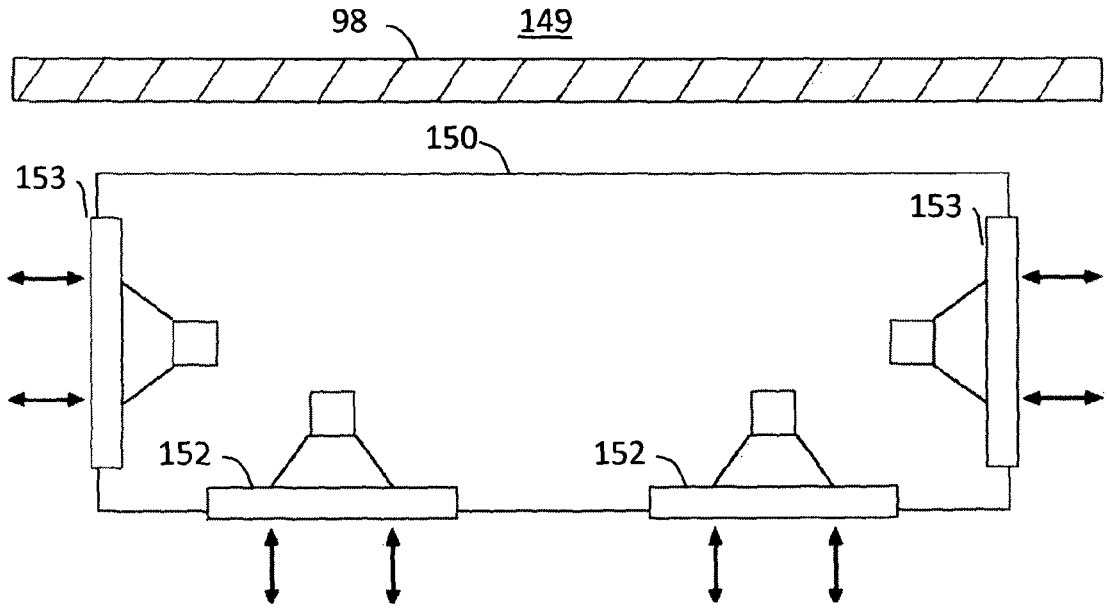

FIGS. 4A and 4B are schematic illustrations of stabilization unit 149, according to some embodiments of the invention. Stabilization unit 149 is connected to suspended platform 150 and arranged to secure a constant contact to external wall 98, to stabilize suspended platform 150 and to direct movements of suspended platform 150. Stabilization unit 149 may comprise, for example supporting wheels 155 or ventilators 152, 153. FIG. 4A illustrates stabilization and direction determination by controlling supporting wheels 155. In particular, some of supporting wheels 155, for example upper supporting wheels 157, may be movably connected to suspended platform 150 by a flexible connection 156, and connected via a shaft 158 to a control unit 159 that may comprise a motor on an actuator. Moving upper supporting wheels 157 allows controlling the motion of suspended platform 150, for example correct its path or change between vertical bands 185, 186 of external wall 98 (movements 187, FIG. 3D). FIG. 4B illustrates stabilization and direction determination by controlling air pressure generated by ventilators 152, 153 at the sides of suspended platform 150 that are remote from external wall 98. For example, ventilators 153 at the sides of suspended platform 150 may control its lateral movements, while ventilators 152 at the back of suspended platform 150 may secure a constant contact to, or keep a predefined gap from external wall 98.

Figure 5:
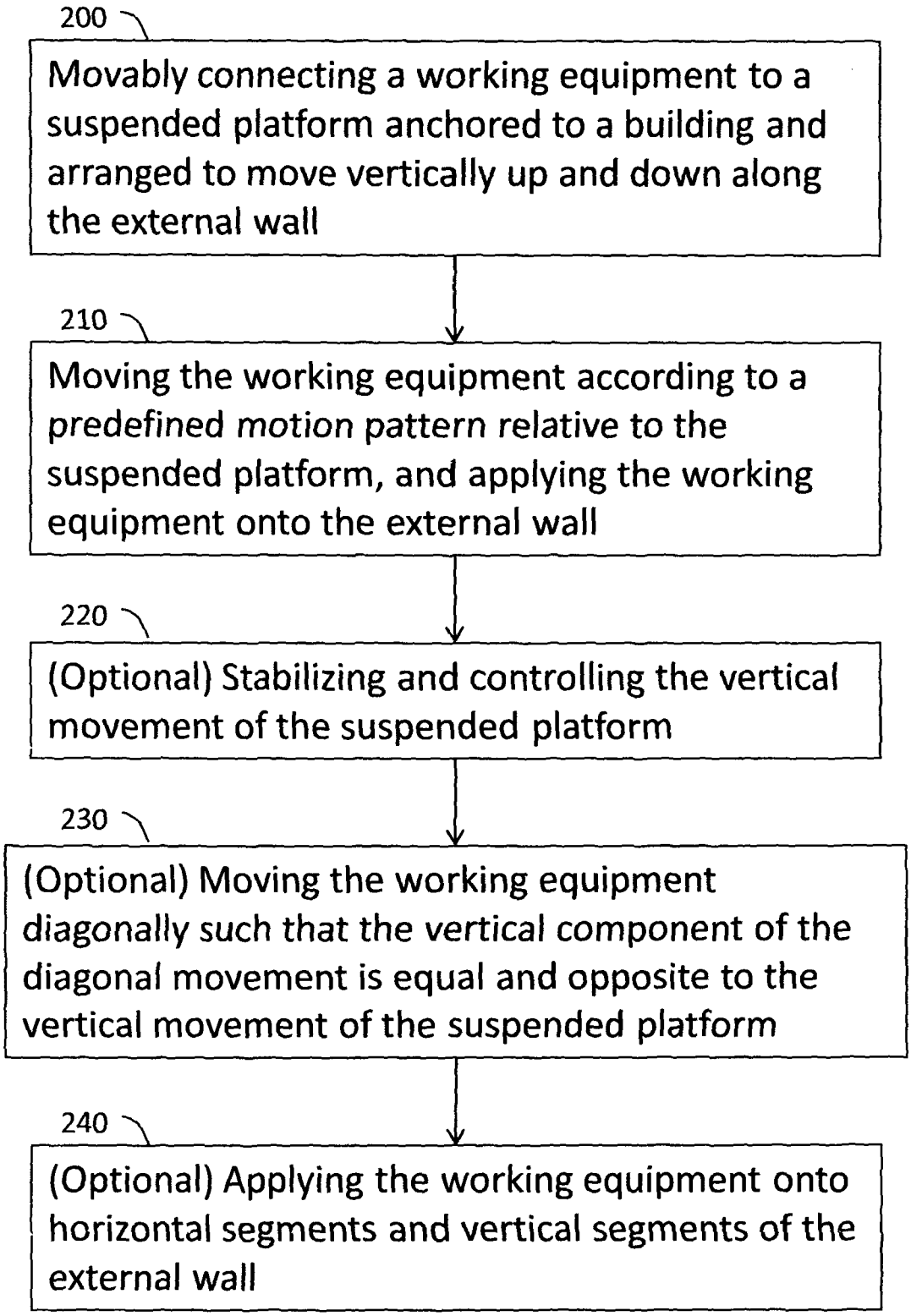
FIG. 5 is a high level schematic flowchart of a method of applying a working equipment onto an external wall of a structure, according to some embodiments of the invention.

FIG. 5 is a high level schematic flowchart of a method of applying a working equipment onto an external wall of a structure, according to some embodiments of the invention. The method comprises: movably connecting the working equipment to a suspended platform anchored to the structure and arranged to move vertically up and down along the external wall (stage 200); and moving the working equipment according to a predefined motion pattern relative to the suspended platform and applying the working equipment onto the external wall (stage 210). The predefined motion pattern is selected such as to allow continuous and uniform application of the working equipment horizontally and vertically onto the external wall during the vertical movement of the suspended platform along the external wall.

According to some embodiments of the invention, the method may further comprise stabilizing and controlling the vertical movement of the suspended platform (stage 220). Stabilization may be achieved by various means, including wheels or ventilators applying pressure to the external wall and the suspended platform.

According to some embodiments of the invention, the predefined motion pattern comprises a diagonal movement comprising a vertical component and a horizontal component, wherein the vertical component is equal and opposed to the vertical movement of the suspended platform. The method may comprise moving the working equipment diagonally such that the vertical component of the diagonal movement is equal and opposite to the vertical movement of the suspended platform (stage 230).

According to some embodiments of the invention, the method may further comprise applying the working equipment onto horizontal segments and onto vertical segments of the external wall (stage 240). Avoidance of overlaps between the segments may allow uniform application of the working equipment.

According to some embodiments of the invention, the working equipment may comprise any of: a painting instrument, a wall cleaning instrument, a wall processing instrument.

According to some embodiments of the invention, the systems and methods disclosed allow automating the processing of external walls 98 while keeping high application standards by compensating for vertical movement 180, 181 of suspended platform 150 by movements of positioning system 100. The net movement allows uniform application of working equipment 99.

In the above description, an embodiment is an example or implementation of the inventions. The various appearances of "one embodiment," "an embodiment" or "some embodiments" do not necessarily all refer to the same embodiments.

Although various features of the invention may be described in the context of a single embodiment, the features may also be provided separately or in any suitable combination. Conversely, although the invention may be described herein in the context of separate embodiments for clarity, the invention may also be implemented in a single embodiment.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined.

The present invention may be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

While the invention has been described with respect to a limited number of embodiments, these should not be construed as limitations on the scope of the invention, but rather as exemplifications of some of the preferred embodiments. Other possible variations, modifications, and applications are also within the scope of the invention. Accordingly, the scope of the invention should not be limited by what has thus far been described, but by the appended claims and their legal equivalents.

What is claimed is:

1. A system for applying working equipment onto an external wall of a structure, the system comprising:

a suspended platform anchored to the structure, operably vertically moveable at a constant speed along the external wall, and arranged to cover a plurality of vertical bands on the external wall by moving up and down the vertical bands;

a positioning system arranged to determine and control a predefined motion pattern of the working equipment relative to motion of the suspended platform, wherein the working equipment and the suspended platform move simultaneously, the positioning system mounted on the suspended platform and the positioning system comprising:

a support connected to the suspended platform;

a conveyor pivotally mounted on the support, the conveyor arranged to be controllably swung on a pivot; and a transporter connected to the conveyor and arranged to be controllably moved along the conveyor according to the predefined motion pattern, wherein the working equipment is connected to the transporter such as to be applicable to the external wall; and wherein the predefined motion pattern is selected such as to allow continuous and uniform application of the working equipment horizontally and vertically onto the external wall during the vertical movement of the suspended platform along the external wall, and wherein the motion of the working equipment create horizontal lines on the external wall, while the suspended platforms moves vertically;

wherein the positioning system diverts the movement of the working equipment in diagonal direction in relation to motion of the suspended platform to enable horizontal straight movement of the working equipment.

2. The system of claim 1, further comprising a piston connected to a motor and to a control unit, the piston arranged to heave and lower the conveyor according to control commands from the control unit.

3. The system of claim 2, wherein the predefined motion pattern comprises a plurality of cycles, each cycle comprising:

vertical movements of the working equipment generated by movements of the vertical piston, in which the working equipment is applied to vertical segments of the external wall; and diagonal movements comprising vertical movements generated by movements of the vertical piston and horizontal movements generated by the fixed horizontal conveyor, wherein the vertical movements are equal and opposed to the vertical movement of the suspended platform, and wherein the horizontal movements are configured to enable applying the working equipment to horizontal segments of the external wall.

4. A system for applying working equipment onto an external wall of a structure, the system comprising:

a suspended platform anchored to the structure, operably vertically moveable at a constant speed along the external wall; and a positioning system arranged to determine and control a predefined motion pattern of the working equipment relative to motion of the suspended platform, the positioning system mounted on the suspended platform, wherein the working equipment and the suspended platform move simultaneously;

wherein the predefined motion pattern is selected such as to allow continuous and uniform application of the working equipment horizontally and vertically onto the external wall during the vertical movement of the suspended platform along the external wall;

wherein the motion of the working equipment create horizontal lines on the external wall, while the suspended platforms moves vertically;

wherein the positioning system diverts the movement of the working equipment in diagonal direction in relation to motion of the suspended platform to enable horizontal straight movement of the working equipment.

5. The system of claim 4, wherein the predefined motion pattern comprises a diagonal movement comprising a vertical component and a horizontal component, wherein the vertical component is equal and opposed to the vertical movement of the suspended platform.

6. The system of claim 4, wherein the suspended platform is arranged to cover a plurality of vertical bands on the external wall by moving up and down the vertical bands.

7. The system of claim 4, further comprising a stabilization unit connected to the suspended platform and arranged to secure a constant contact to the external wall, stabilize of the suspended platform and direct movements of the suspended platform.

8. The system of claim 7, wherein the stabilization unit comprises a plurality of supporting wheels connected to the suspended platform and arranged to stabilize and direct movements of the suspended platform.

9. The system of claim 7, wherein the stabilization unit comprises a plurality of ventilators connected to the suspended platform and arranged to at least one of:

secure a constant contact to the external wall, stabilize the suspended platform, keep a predefined gap from the external wall.

10. The system of claim 4, wherein the working equipment comprises at least one of: a painting instrument, a wall cleaning instrument, a wall processing instrument.

11. The system of claim 4, wherein the predefined motion pattern comprises a plurality of cycles, each cycle comprising:

vertical movements in which the working equipment is applied to vertical segments of the external wall; and diagonal movements comprising a vertical component and a horizontal component, wherein the vertical component is equal and opposed to the vertical movement of the suspended platform, and in which the working equipment is applied to horizontal segments of the external wall.

12. The system of claim 11, further comprising a motor connected to the transporter and to a control unit, the control unit arranged to move the transporter according the predefined motion pattern in relation to movements of the conveyor.

13. The system of claim 11, wherein the predefined motion pattern comprises a plurality of cycles, each cycle comprising:

vertical movements of the transporter generated by swings of the conveyor, in which the working equipment is applied to vertical segments of the external wall; and diagonal movements of the transporter along the conveyor, each diagonal movement comprising a vertical component and a horizontal component, wherein the vertical component is equal and opposed to the vertical movement of the suspended platform, and in which the working equipment is applied to horizontal segments of the external wall.

14. The system of claim 4, wherein the positioning system comprises:

a support connected to the suspended platform;

a conveyor pivotally mounted on the support, the conveyor arranged to be controllably swung on a pivot; and a transporter connected to the conveyor and arranged to be controllably moved along the conveyor according to the predefined motion pattern, wherein the working equipment is connected to the transporter such as to be applicable to the external wall.

15. The system of claim 4, wherein the positioning system comprises:

a support connected to the suspended platform;

a fixed horizontal conveyor mounted on the support; and a transporter connected to the fixed horizontal conveyor and arranged to be controllably moved along the conveyor according to the predefined motion pattern, the transporter comprising a vertical piston, wherein the working equipment is connected to the vertical piston such as to be applicable to the external wall, and wherein the vertical piston is arranged to controllably move the working equipment according to the predefined motion pattern in relation to the controlled movements of the transporter on the fixed horizontal conveyor.

* * * * *